US011006233B2

(12) United States Patent
Dai et al.

(10) Patent No.: US 11,006,233 B2
(45) Date of Patent: May 11, 2021

(54) METHOD AND TERMINAL FOR PLAYING AUDIO FILE IN MULTI-TERMINAL COOPERATIVE MANNER

(71) Applicant: Huawei Technologies Co., Ltd., Shenzhen (CN)

(72) Inventors: Hengjie Dai, Hangzhou (CN); Hequn Bai, Shenzhen (CN); Dezhu Xu, Hangzhou (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 16/913,166

(22) Filed: Jun. 26, 2020

(65) Prior Publication Data

US 2020/0329329 A1 Oct. 15, 2020

Related U.S. Application Data

(63) Continuation of application No. PCT/CN2018/124244, filed on Dec. 27, 2018.

(30) Foreign Application Priority Data

Dec. 31, 2017 (CN) ..... 201711494923.7

(51) Int. Cl.
*H04S 7/00* (2006.01)
*H04S 3/00* (2006.01)

(52) U.S. Cl.
CPC . *H04S 7/30* (2013.01); *H04S 3/00* (2013.01)

(58) Field of Classification Search
None
See application file for complete search history.

(56) References Cited

U.S. PATENT DOCUMENTS

2007/0087686 A1 4/2007 Holm et al.
2008/0077261 A1 3/2008 Baudino et al.
2014/0146970 A1 5/2014 Kim et al.
2015/0243270 A1 8/2015 Goossens et al.
(Continued)

FOREIGN PATENT DOCUMENTS

CN 1179074 A 4/1998
CN 103702274 A 4/2014
(Continued)

*Primary Examiner* — Kenny H Truong
(74) *Attorney, Agent, or Firm* — Conley Rose, P.C.

(57) ABSTRACT

A method and a terminal for playing an audio file in a multi-terminal cooperative manner include obtaining, by a source terminal, an audio signal frame, the audio signal frame includes a left channel signal and a right channel signal, obtaining, by the source terminal, a central channel signal and a surround channel signal based on the left channel signal and the right channel signal, obtaining, by the source terminal, a current location of a virtual sound source corresponding to the central channel signal, and generating, based on the current location and the central channel signal, a sound channel signal corresponding to the terminal in at least two sound channel signals, superposing, by the source terminal, the sound channel signal on the surround channel signal, to obtain a to-be-played sound channel signal corresponding to the terminal, and playing, by the source terminal, the to-be-played sound channel signal.

20 Claims, 4 Drawing Sheets

(56) References Cited

U.S. PATENT DOCUMENTS

| | | | | |
|---|---|---|---|---|
| 2017/0238118 | A1* | 8/2017 | Bahne | H04R 3/12 700/94 |
| 2019/0268697 | A1 | 8/2019 | Liu et al. | |

FOREIGN PATENT DOCUMENTS

| | | | |
|---|---|---|---|
| CN | 104396279 | A | 3/2015 |
| CN | 104871566 | A | 8/2015 |
| CN | 106502620 | A | 3/2017 |
| CN | 106993249 | A | 7/2017 |
| WO | 2015077713 | A1 | 5/2015 |
| WO | 2015120633 | A1 | 8/2015 |

* cited by examiner

METHOD AND TERMINAL FOR PLAYING AUDIO FILE IN MULTI-TERMINAL COOPERATIVE MANNER

CROSS-REFERENCE TO RELATED APPLICATIONS

This application is a continuation of International Patent Application No. PCT/CN2018/124244 filed on Dec. 27, 2018, which claims priority to Chinese Patent Application No. 201711494923.7 filed on Dec. 31, 2017. The disclosures of the aforementioned applications are hereby incorporated by reference in their entireties.

TECHNICAL FIELD

The present disclosure relates to the field of terminal technologies, and in particular, to a method and a terminal for playing an audio file in a multi-terminal cooperative manner.

BACKGROUND

With rapid development of electronic technologies, terminals such as a personal computer, a smartphone, and a personal digital assistant (PDA) are favored by a large quantity of users due to powerful functions of the terminals, and application of the terminals is increasingly extensive.

Currently, most terminals have an audio playback function. To ensure a playback effect of an audio file or increase playback volume of an audio file, a same audio file may be cooperatively played using a plurality of terminals. In this case, different terminals may play different sub-channel files, to achieve an objective of improving a play effect of an audio file. The foregoing different terminals may also play the entire audio file, to achieve an effect of increasing play volume of the audio file. Usually, one terminal is selected from the plurality of terminals that perform the cooperative play operation as a source terminal, and another terminal different from the source terminal is used as a sink terminal. The source terminal sends a preset sub-channel file to each sink terminal based on pre-configured information, and after determining that transmission of the sub-channel file is completed in each terminal, controls the foregoing cooperative play process of the plurality of terminals.

However, in other approaches, because a preset sub-channel file is played in a mobile phone, a sound surround effect brought to a user is not strong.

SUMMARY

An objective of the embodiments of the present disclosure is to provide a method for playing an audio file in a multi-terminal cooperative manner, to improve a spatial surround effect of audio.

The foregoing objective and other objectives are achieved using features in the independent claims. Further implementations are reflected in the dependent claims, the specification, and the accompanying drawings.

According to a first aspect, a method for playing an audio file in a multi-terminal cooperative manner is provided. The method includes obtaining, by a terminal, an audio file, where the audio file includes an audio signal frame, and the audio signal frame includes a left channel signal and a right channel signal, obtaining, by the terminal, a central channel signal and a surround channel signal based on the left channel signal and the right channel signal, obtaining, by the terminal, a current location of a virtual sound source corresponding to the central channel signal, and generating, based on the current location and the central channel signal, a sound channel signal corresponding to the terminal in at least two sound channel signals, where the at least two sound channel signals are used to simulate a current sound field of the virtual sound source, superposing, by the terminal, the sound channel signal corresponding to the terminal on the surround channel signal, to obtain a to-be-played sound channel signal corresponding to the terminal, and playing, by the terminal, the to-be-played sound channel signal corresponding to the terminal.

The foregoing method may be performed by a source terminal, or may be executed by a sink terminal.

The signal may be understood as audio data, for example, to-be-processed audio data. For example, the sound channel signal may be understood as sound channel audio data, and the signal frame may be understood as a data frame.

The sound channel signal corresponding to the terminal means that there are at least two terminals in a cooperative playing system, and the terminals play different channel signals. A correspondence between the terminal and the channel signal may be implemented using a preset correspondence, for example, a correspondence between a sequence number of the terminal and a sequence number of a sound channel. Alternatively, the sound channel signal corresponding to the terminal may be determined based on a relative location relationship between the terminal and another terminal in the at least two terminals.

The simulating a current sound field of the virtual sound source may mean that simulating a sound field that is generated at a human ear location when the virtual sound source is at the current location. The human ear location may be detected by the source terminal, or may be preset.

With reference to the first aspect, in a first possible implementation of the first aspect, the terminal is a source terminal, and the method further includes controlling, by the source terminal, at least one sink terminal to play at least one to-be-played sound channel signal different from the to-be-played sound channel signal corresponding to the source terminal in the at least two to-be-played sound channel signals, to control the at least one sink terminal to cooperatively play the at least two to-be-played sound channel signals with the terminal.

The at least one sink terminal may be at least two sink terminals, at least three sink terminals, or at least four sink terminals.

The at least one sink terminal is in one-to-one correspondence with the at least one to-be-played sound channel signal, that is, one terminal in the at least one sink terminal corresponds to one sound channel signal in the at least one to-be-played sound channel signal. Controlling at least one sink terminal to play at least one to-be-played sound channel signal different from the to-be-played sound channel signal corresponding to the source terminal in the at least two to-be-played sound channel signals may further include controlling the at least one sink terminal to play a respective sound channel signal corresponding to the at least one sink terminal in the at least one to-be-played sound channel signal.

With reference to the first aspect or the first possible implementation of the first aspect, in a second possible implementation of the first aspect, obtaining a current location of a virtual sound source corresponding to the central channel signal includes obtaining a movement speed of the virtual sound source and moment information of the audio signal frame, and determining, based on a preset movement track of the virtual sound source, the movement speed, and the moment information, the current location of the virtual sound source on the movement track.

The moment information may be determined based on a frame sequence number of the audio signal frame.

Determining a current location of a virtual sound source may include determining the current location based on a difference between the moment information and stored previous moment information before the moment information, a location corresponding to the stored previous time information on the movement track, and the movement speed. The method may further include storing the current location and the moment information, where the current location corresponds to the moment information.

With reference to the second possible implementation of the first aspect, in a third possible implementation of the first aspect, the audio signal frame includes music data, and the obtaining a movement speed of the virtual sound source includes determining rhythm information of music indicated by the audio signal frame, and determining the movement speed based on the rhythm information, where a faster rhythm indicated by the rhythm information indicates a faster movement speed.

The music indicated by the audio signal frame is music generated by playing the audio signal frame.

With reference to the third possible implementation of the first aspect, in a fourth possible implementation of the first aspect, determining rhythm information of music indicated by the audio signal frame includes determining the rhythm information based on the audio signal frame and N signal frames before the audio signal frame in the audio file, where N is an integer greater than 0.

With reference to the second possible implementation, the third possible implementation, or the fourth possible implementation of the first aspect, in a fifth possible implementation of the first aspect, the movement track is a circle that rotates around a preset human ear location.

With reference to the fifth possible implementation of the first aspect, in a sixth possible implementation of the first aspect, the terminal is the source terminal, and the source terminal or the at least one sink terminal controlled by the source terminal is located in a plane in which the circle is located. According to a second aspect, a terminal for playing an audio file in a multi-terminal cooperative manner is provided. The terminal includes a first obtaining unit configured to obtain an audio file, where the audio file includes an audio signal frame, and the audio signal frame includes a left channel signal and a right channel signal, a second obtaining unit configured to obtain a central channel signal and a surround channel signal based on the left channel signal and the right channel signal, a generation unit configured to generate a current location of a virtual sound source corresponding to the central channel signal, and generate, based on the current location and the central channel signal, a sound channel signal corresponding to the terminal in at least two sound channel signals, where the at least two sound channel signals are used to simulate a current sound field of the virtual sound source, a superposition unit configured to superpose the sound channel signal corresponding to the terminal on the surround channel signal, to obtain a to-be-played sound channel signal corresponding to the terminal, and a playback unit configured to play the to-be-played sound channel signal corresponding to the terminal.

With reference to the second aspect, in a first possible implementation of the second aspect, the terminal is a source terminal, and the source terminal further includes a controlling unit configured to control at least one sink terminal to play at least one to-be-played sound channel signal different from the to-be-played sound channel signal corresponding to the source terminal in the at least two to-be-played sound channel signals, to control the at least one sink terminal to cooperatively play the at least two to-be-played sound channel signals with the terminal.

With reference to the second aspect or the first possible implementation of the second aspect, in a second possible implementation of the second aspect, the generation unit is configured to obtain a movement speed of the virtual sound source and moment information of the audio signal frame, and determine, based on a preset movement track of the virtual sound source, the movement speed, and the moment information, the current location of the virtual sound source on the movement track.

With reference to the second possible implementation of the second aspect, in a third possible implementation of the second aspect, the audio signal frame includes music data, and the generation unit is configured to determine rhythm information of music indicated by the audio signal frame, and determine the movement speed based on the rhythm information, where a faster rhythm indicated by the rhythm information indicates a faster movement speed.

With reference to the third possible implementation of the second aspect, in a fourth possible implementation of the second aspect, the generation unit is configured to determine the rhythm information based on the audio signal frame and N signal frames before the audio signal frame in the audio file, where N is an integer greater than 0.

With reference to the second possible implementation, the third possible implementation, or the fourth possible implementation of the second aspect, in a fifth possible implementation of the second aspect, the movement track is a circle that rotates around a preset human ear location.

With reference to the fifth possible implementation of the second aspect, in a sixth possible implementation of the second aspect, the terminal is the source terminal, and the source terminal or the at least one sink terminal controlled by the source terminal is located in a plane in which the circle is located.

According to a third aspect, a terminal for playing an audio file in a multi-terminal cooperative manner is provided. The terminal includes a memory and a processor, where the memory is configured to store a set of executable code, and the processor is configured to execute the executable code stored in the memory, to perform any one of the first aspect or the possible implementations of the first aspect.

According to a fourth aspect, a storage medium is provided. The storage medium stores executable code, and when the executable code is executed, any one of the first aspect or the possible implementations of the first aspect may be performed.

According to a fifth aspect, a computer program is provided. The computer program may perform any one of the first aspect or the possible implementations of the first aspect.

According to a sixth aspect, a computer program product is provided. The computer program product includes an instruction that can execute any one of the first aspect or the possible implementations of the first aspect.

BRIEF DESCRIPTION OF DRAWINGS

To describe the technical solutions in some of the embodiments of the present disclosure more clearly, the following briefly describes the accompanying drawings describing some of the embodiments.

DESCRIPTION OF EMBODIMENTS

The following describes the technical solutions in the embodiments of the present disclosure with reference to the accompanying drawings in the embodiments of the present disclosure.

Figure 1:
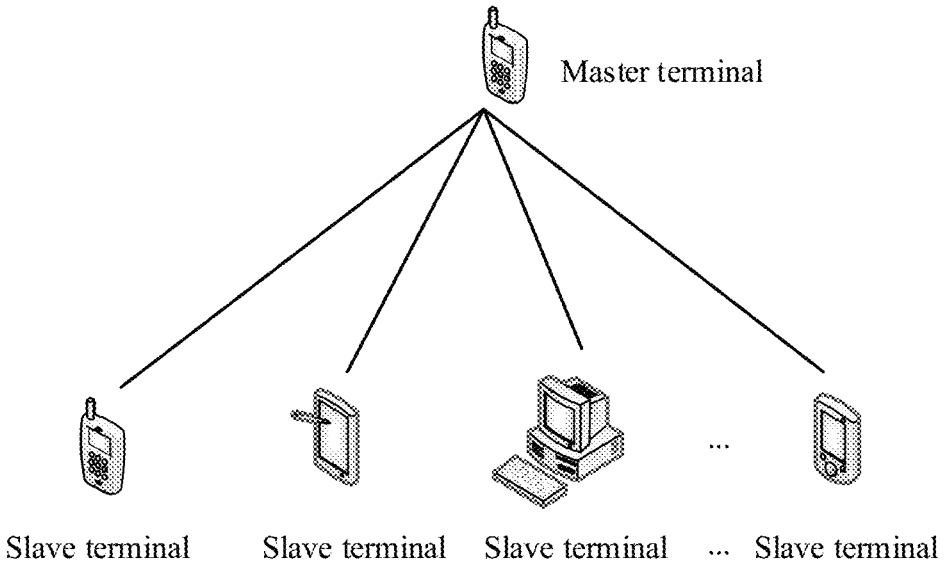
FIG. 1 is an architectural diagram of a system for playing an audio file in a multi-terminal cooperative manner according to an embodiment of the present disclosure.

FIG. 1 is an architectural diagram of a system according to an embodiment of the present disclosure. A source terminal may cooperatively play an audio file with one sink terminal, or may cooperatively play an audio file with a plurality of sink terminals. It should be noted that in this embodiment of the present disclosure, a plurality of terminals may be at least two terminals, at least three terminals, at least four terminals, three terminals, four terminals, five terminals, six terminals, seven terminals, or eight terminals.

In this embodiment of the present disclosure, terminals participating in cooperative playing of an audio file establish a connection to each other in a wired or wireless manner. A person skilled in the art may understand that the "terminal" and a "terminal device" used herein include a device that has a wireless signal receiver having no transmit capability, and further include a device that has receiving and transmitting hardware having a capability of performing bidirectional communication on a bidirectional communication link. Such a device may include a cellular device or another communication device that has a single line display or a multiline display or has no multiline display, a personal communications service (PCS), where voice, data processing, fax, and/or data communication capabilities may be combined in the PCS, a PDA that may include a radio frequency receiver, a pager, an Internet/intranet access module, a web browser, a notepad, a calendar, and/or a Global Positioning System (GPS) receiver, and a conventional laptop and/or palmtop computer or another device that has and/or includes a radio frequency receiver. The "terminal" and the "terminal device" used herein may be portable, transportable, and installed in a vehicle (a vehicle on air, sea, and/or land), or suitable for running and/or configured to run locally, and/or run at any other location on Earth and/or in space in a distributed form. The "terminal" and the "terminal device" used herein may further be a communications terminal, an Internet access terminal, and a music/video playing terminal, for example, may be a PDA, a mobile Internet device (MID), and/or a mobile phone having a music/video playing function, or may be a device such as a smart television or a set-top box. After connections between the terminals participating in cooperative playing of the audio file are established, the terminals need to be configured, to be specific, a source terminal and a sink terminal are configured, where the source terminal and the sink terminal are the terminals. The source terminal may be specified by a user, or may be determined based on a pre-configuration. Usually, any terminal in terminals including a specified audio file is used as a source terminal, and another terminal participating in cooperative playing of the audio file that is different from the source terminal is used as a sink terminal.

After the source terminal and the sink terminal are configured, the source terminal serves as a playback control unit to transmit a multi-channel audio file (the audio file includes a channel signal) and deliver a control instruction to the sink terminal. In this embodiment of the present disclosure, the user may send a control instruction using the source terminal to another terminal in a terminal group, where the control instruction includes an instruction such as a playback instruction or a playback stop instruction. The source terminal and the sink terminal may perform one or more types of cooperative sound effect processing based on a song and a playing mode that are selected by the user. There may be one or more sink terminals participating in cooperative playing of the audio file.

Figure 2:
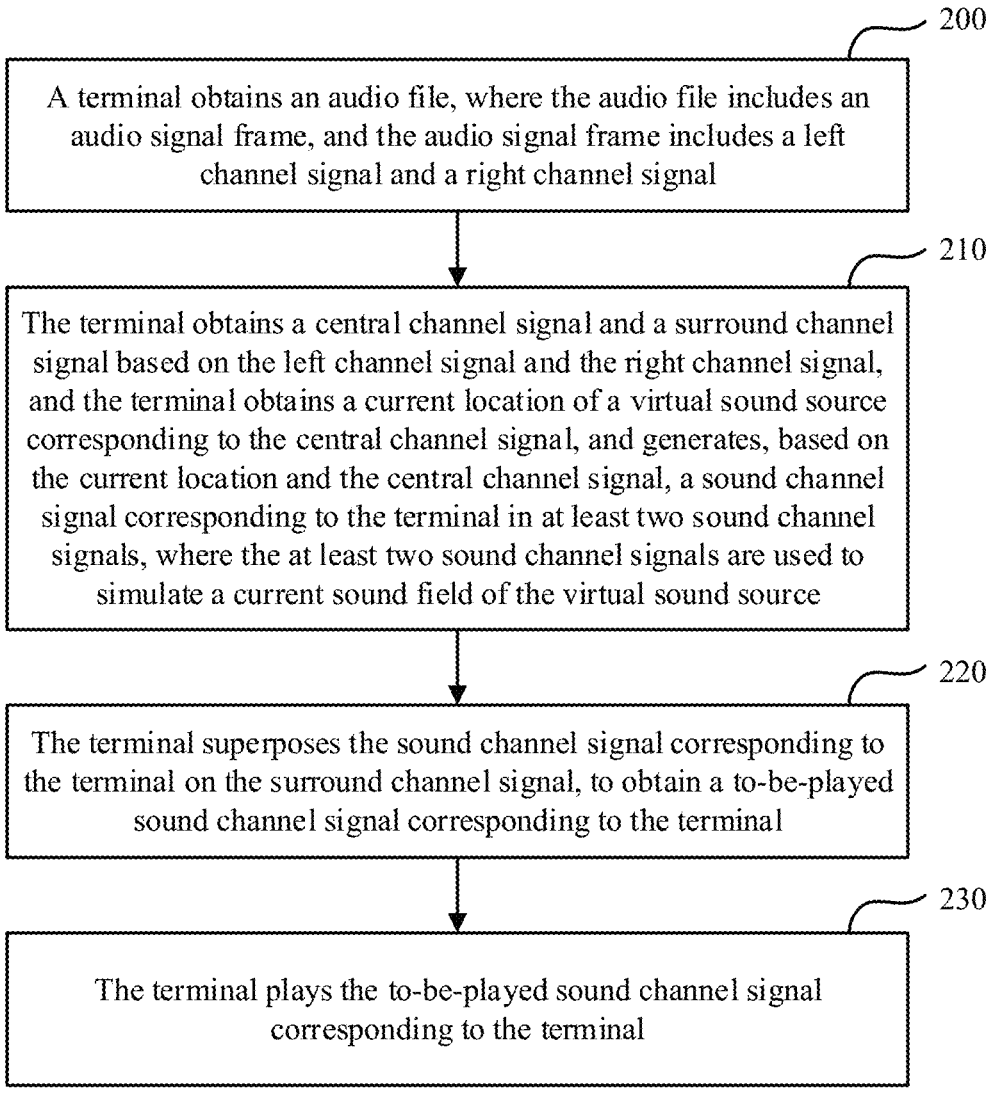
FIG. 2 is a flowchart of a method for playing an audio file in a multi-terminal cooperative manner according to an embodiment of the present disclosure.

Referring to FIG. 2, in an embodiment of the present disclosure, an execution body may be a source terminal, a sink terminal, or a non-terminal-type computer device. The following uses the source terminal as an example for description. A process in which a plurality of terminals cooperatively play an audio file is as follows.

Step 200: A terminal obtains the audio file, where the audio file includes an audio signal frame, and the audio signal frame includes a left channel signal and a right channel signal.

The signal may be understood as audio data, for example, to-be-processed audio data. For example, the sound channel signal may be understood as sound channel audio data, and the signal frame may be understood as a data frame.

Step 210: The terminal obtains a central channel signal and a surround channel signal based on the left channel signal and the right channel signal, and the terminal obtains a current location of a virtual sound source corresponding to the central channel signal, and generates, based on the current location and the central channel signal, a sound channel signal corresponding to the terminal in at least two sound channel signals, where the at least two sound channel signals are used to simulate a current sound field of the virtual sound source.

The sound channel signal corresponding to the terminal may be generated using a speaker virtual mapping technology. This technology encodes the virtual sound source to an Ambisonic domain through spherical harmonic decomposition based on a location of the virtual sound source in a Cartesian coordinate system, calculates a decoding matrix based on a location of a playback speaker, and decodes the encoded file to the speaker for playback.

During specific implementation, generating the at least two sound channel signals based on the current location and the central channel signal may include generating the at least two sound channel signals based on the current location, the central channel signal, a human ear location, and location distribution of the terminal group. During specific implementation, a source terminal may control each terminal in the terminal group to send an ultrasonic wave, and each terminal calculates a distance between terminals based on the ultrasonic wave, to obtain location distribution of the terminal group. The terminal group includes the source terminal and at least one sink terminal. For example, a source terminal A instructs a terminal B to send an ultrasonic wave, and after sending the ultrasonic wave, the terminal B sends, to the source terminal A, a time at which the ultrasonic wave is sent. The source terminal A calculates a distance between the terminal B and the terminal A based on the time at which the terminal B sends the ultrasonic wave and a time at which the terminal A receives the ultrasonic wave. In this way, location distribution of the terminals in the terminal group is obtained. In another implementation, location distribution of the terminal group is preset. Similarly, when the terminal group is used to play audio, a user may be required to place the terminal group based on a preset location.

Obtaining a current location of a virtual sound source corresponding to the central channel signal may include obtaining a movement speed of the virtual sound source and moment information of the audio signal frame, and determining, based on a preset movement track of the virtual sound source, the movement speed, and the moment information, the current location of the virtual sound source on the movement track.

In a possible implementation, the audio signal frame includes music data, and obtaining a movement speed of the virtual sound source may include determining rhythm information of music indicated by the audio signal frame, and determining the movement speed based on the rhythm information, where a faster rhythm indicated by the rhythm information indicates a faster movement speed. Determining rhythm information of music indicated by the audio signal frame may include determining the rhythm information based on the audio signal frame and N signal frames before the audio signal frame in the audio file, where N is an integer greater than 0.

In a possible implementation, the movement track may be a circle that rotates around a human ear location. Further, the source terminal or the at least one sink terminal controlled by the source terminal may be located in a plane in which the circle is located. Alternatively, the source terminal and the at least one sink terminal may be located in a plane in which the circle is located. Certainly, the source terminal or the at least one sink terminal may be located at the circle. During actual application, the human ear location may be a location at which the user performs entering using a user interface (UI) of the source terminal. Alternatively, the human ear location may be a preset relative location relative to the source terminal and/or a specific sink terminal (or some sink terminals).

Alternatively, a terminal (a source terminal or a sink terminal) photographs a head picture of a user, to determine a listening location of the user as the human ear location.

Step 220: The terminal superposes a channel signal corresponding to the terminal on the surround channel signal, to obtain a to-be-played sound channel signal corresponding to the terminal.

Step 230: The terminal plays the to-be-played sound channel signal corresponding to the terminal.

When the terminal is a source terminal, the method may further include controlling, by the source terminal, at least one sink terminal to play at least one to-be-played sound channel signal different from the to-be-played sound channel signal corresponding to the source terminal in the at least two to-be-played sound channel signals, to control the at least one sink terminal to cooperatively play the at least two to-be-played sound channel signals with the terminal. It may be understood that for more content, refer to related descriptions in content of the present disclosure. Details are not described herein again.

An embodiment of the present disclosure further provides a system for playing an audio file in a multi-terminal cooperative manner. The system includes the source terminal that performs the foregoing method that may be performed by the source terminal, and the sink terminal that performs the foregoing method that may be performed by the sink terminal. It should be noted that if it is not specially noted that a method is performed by the source terminal, the method may be performed by the source terminal, or may be performed by the sink terminal.

The following provides a description with reference to a specific application scenario. The application scenario may be as follows. When a plurality of people gathers, a plurality of mobile phones is placed at a predetermined location around a gathering site, and are simultaneously connected to a same Wi-Fi hotspot. The mobile phones use the Wi-Fi hotspot to communicate with each other, play music, and make a human voice (a central channel signal) act as a rhythmic movement element between devices. When a user chooses to play relatively comfortable music, the movement element moves slowly between devices, bringing an elegant party experience. When the user chooses to play a song with a strong rhythm, the movement element has a quick rhythm based on the rhythm of the song, thereby increasing a sense of rhythm for the party.

Herein, an example in which the system for playing an audio file in a multi-terminal cooperative manner includes three terminals (a terminal A, a terminal B, and a terminal C) and the terminal A, the terminal B, and the terminal C cooperatively play an audio file is used to describe a method procedure for cooperatively playing an audio file by a plurality of terminals and a system for playing an audio file in a multi-terminal cooperative manner. The procedure includes the following steps.

Step 0: Establish a connection relationship between the terminal A, the terminal B, and the terminal C, where the terminal A is configured as a source terminal, and the terminal B and the terminal C are configured as sink terminals.

Step 1: The terminal A obtains an audio file, and divides the audio file into signal frames of a same size.

That sizes are the same may mean that quantities of sampling points in all frames are the same. The audio file may be a stereo audio file, a 5.1-channel audio file, a 7.1-channel audio file, or the like, and these audio files are not further listed one by one herein.

Step 2: The terminal A obtains a user-preset movement curve and an initial location of a virtual sound source on the movement curve, where the movement curve may be a circle, and the terminal A, the terminal B, and the terminal C are located in a plane in which the circle is located. The reason is that simulation of a sound field in the plane is easier than that in space.

The movement curve may be a function about a time and three-dimensional coordinates. The movement curve is a movement curve of the virtual sound source.

A central extraction technology is to extract the virtual central channel signal from a dual-channel input sound source in a channel upmixing manner. There are different methods for implementing channel upmixing. Some methods use matrix decoding that is performed in time domain. Some methods are based on signal correlation. For example, it is assumed that left, central, and right signals (L, C, and R) obtained after the left and right channel signals are upmixed are not correlated. In this case, the central channel signal is extracted in frequency domain.

Extraction of the surround channel signal may be extracting anticorrelated surrounding information in time domain using a left and right channel de-correlation method. For example, an azimuth is calculated based on energy of left and right channels, and weighting factors of the left and right channels are calculated based on azimuth information, for example, SL=a*L+b*R, where a and b are calculated weighting factors. Specific implementation may be a surround sound S=L*0.4−R*0.3.

Step 3: In a process in which the virtual sound source moves, the terminal A detects rhythm information of music indicated by a current audio signal frame, and updates a movement speed based on the rhythm information. The faster the rhythm information is, the faster the movement speed is.

It should be noted that if the rhythm information is detected for the first time, it means that the movement speed is not updated previously. In this case, for the rhythm information detected for the first time, the movement speed is determined based on the detected rhythm information.

Further, a manner in which movement information is updated may be determining, based on the rhythm information, a movement speed corresponding to the rhythm information, where the movement speed is used to update the movement information. Alternatively, after the movement speed corresponding to the rhythm information is determined, a weight sum of the movement speed and a movement speed that corresponds to previous rhythm information and that is determined based on the rhythm information last time may be used as an updated movement speed. In this case, in step 2, an initial value of the movement speed needs to be obtained.

Rhythm information of music indicated by a current audio signal frame and N frames before the current audio signal frame may be detected and used as rhythm information of music indicated by the current audio signal frame, where N may be 10.

Step 4: The terminal A determines the current location of the virtual sound source based on the moment information indicated by a sequence number of the current audio signal frame, the moment information corresponding to a previous audio signal frame, a location of a previous virtual sound source, and the updated movement speed. The current location may be represented using a three-dimensional coordinate value. The location of the virtual sound source may be understood as a location of the human sound or the instrument sound.

The moment information corresponding to the previous audio signal frame and the location of the previous virtual sound source may be, when the moment speed is updated last time, moment information corresponding to an analyzed audio signal frame and a location of a determined virtual sound source.

Further, the terminal A may obtain a difference between the moment information indicated by the sequence number of the current audio signal frame and the moment information corresponding to the previous audio signal frame, and then determine the current location, where a displacement of the current location relative to the previous location along the movement track is a product of the difference and the updated movement speed.

Step 5: The terminal A obtains the central channel signal and the surround channel signal based on the current audio signal frame in the audio file.

Step 6: The terminal A processes the central channel signal based on the current location of the virtual sound source, to obtain a channel signal corresponding to the terminal A in three channel signals. The three sub-channel signals are used to simulate a sound field that is at a human ear location when the virtual sound source is at the current location.

Step 7: The terminal A superposes the channel signal corresponding to the terminal A on the surround channel signal, to obtain a to-be-played sound channel signal used for playing by the terminal A.

Step 8: Similar to that the terminal A obtains the to-be-played sound channel signal used for playing by the terminal A, the terminal B obtains a to-be-played sound channel signal used for playing by the terminal B, and the terminal C obtains a to-be-played sound channel signal used for playing by the terminal C.

Step 9: The terminal A controls the terminal A to play the to-be-played sound channel signal used for playing by the terminal A, controls the terminal B to play the to-be-played sound channel signal used for playing by the terminal B, and controls the terminal C to play the to-be-played sound channel signal used for playing by the terminal C.

Step 10: When all signal frames in the audio file are processed, the procedure ends, otherwise, step 3 is performed.

Figure 3:
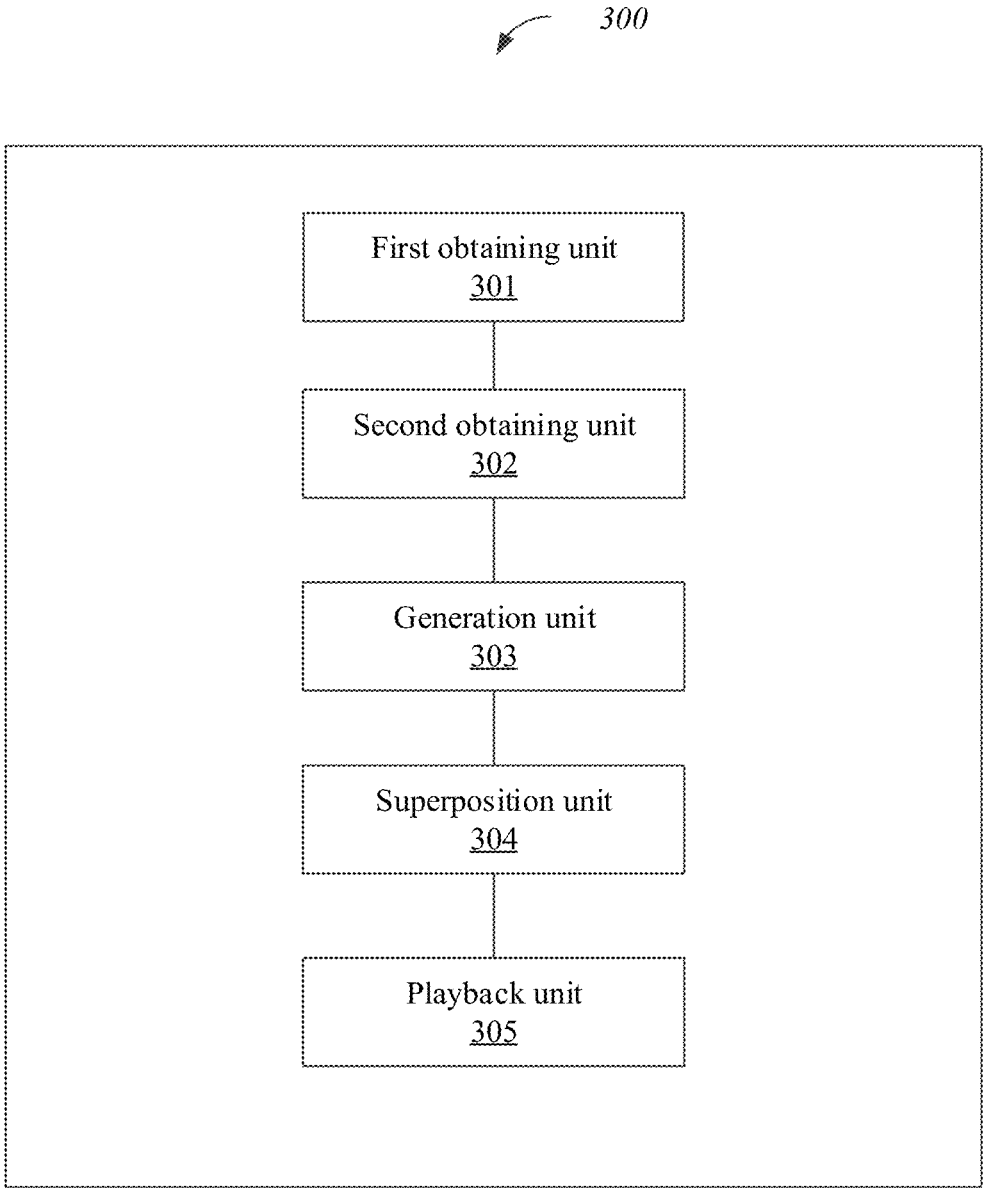
FIG. 3 is a schematic structural diagram of a terminal configured to play an audio file in a multi-terminal cooperative manner according to an embodiment of the present disclosure.

As shown in FIG. 3, an embodiment of the present disclosure provides a terminal 300 for playing an audio file in a multi-terminal cooperative manner. The terminal 300 is a source terminal, and the terminal 300 may include a first obtaining unit 301, a second obtaining unit 302, a generation unit 303, a superposition unit 304, and a sending unit 305. Operations performed by the units in the terminal 300 may be implemented using software, and may be used as a software module located in a memory of the terminal 300 and invoked and executed by a processor. The operations performed by the units in the apparatus may be alternatively implemented using a hardware chip.

The first obtaining unit 301 is configured to obtain an audio file, where the audio file includes an audio signal frame, and the audio signal frame includes a left channel signal and a right channel signal.

The second obtaining unit 302 is configured to obtain a central channel signal and a surround channel signal based on the left channel signal and the right channel signal.

The generation unit 303 is configured to generate a current location of a virtual sound source corresponding to the central channel signal, and generate, based on the current location and the central channel signal, a sound channel signal corresponding to terminal in at least two sound channel signals, where the at least two sound channel signals are used to simulate a current sound field of the virtual sound source.

The generation unit 303 may be configured to obtain a movement speed of the virtual sound source and moment information of the audio signal frame, and determine, based on a preset movement track of the virtual sound source, the movement speed, and the moment information, the current location of the virtual sound source on the movement track.

In a possible implementation, the audio signal frame includes music data, and the generation unit 303 may be configured to determine rhythm information of music indicated by the audio signal frame, and determine the movement speed based on the rhythm information, where a faster rhythm indicated by the rhythm information indicates a faster movement speed. The generation unit 303 may be configured to determine the rhythm information based on the audio signal frame and N signal frames before the audio signal frame in the audio file, where N is an integer greater than 0. The movement track may be a circle that rotates around a preset human ear location. The source terminal or the at least one sink terminal may be located in a plane in which the circle is located.

In a possible implementation, the generation unit 303 generates the at least two sound channel signals based on the current location and the central channel signal only when the current location does not overlap a location of a playback terminal, where the playback terminal is the source terminal, or the playback terminal is one of the at least one sink terminal.

The superposition unit 304 is configured to superpose the sound channel signal corresponding to the terminal on the surround channel signal, to obtain a to-be-played sound channel signal corresponding to the terminal.

The playback unit 305 is configured to play the to-be-played sound channel signal corresponding to the terminal.

When the terminal 300 is the source terminal, the terminal 300 may further include a controlling unit (not shown) configured to control at least one sink terminal to play at least one to-be-played sound channel signal different from the to-be-played sound signal corresponding to the source terminal in the at least two to-be-played sound channel signals, to control the at least one sink terminal to cooperatively play the at least two to-be-played sound channel signals with the terminal.

It may be understood that, for more operations performed by the units of the terminal in this embodiment, refer to related descriptions in the foregoing method embodiments and the summary. Details are not described herein again.

Figure 4:
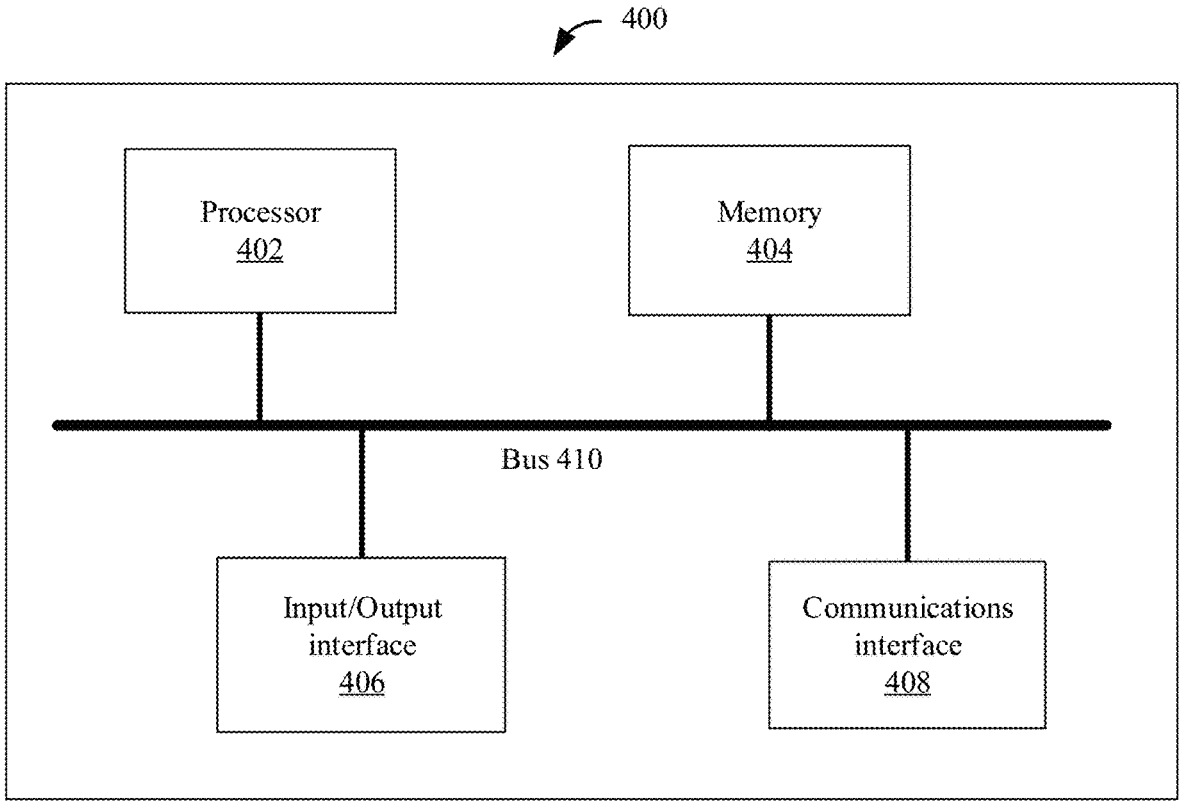
FIG. 4 is a schematic structural diagram of a terminal configured to play an audio file in a multi-terminal cooperative manner according to an embodiment of the present disclosure.

FIG. 4 is a schematic structural diagram of a terminal 400 configured to play an audio file in a multi-terminal cooperative manner according to an embodiment of the present disclosure. As shown in FIG. 4, the terminal 400 may be used as an implementation of the terminal 300. The terminal 400 includes a processor 402, a memory 404, an input/output interface 406, a communications interface 408, and a bus 410. The processor 402, the memory 404, the input/output interface 406, and the communications interface 408 implement a mutual communication connection using the bus 410.

The processor 402 may be a general-purpose central processing unit (Central Processing Unit (CPU)), a microprocessor, an application-specific integrated circuit (ASIC), or one or more integrated circuits, and is configured to execute a related program, to implement functions that units included in the device 300 provided in the embodiments of the present disclosure needs to perform, or perform the methods for playing an audio file in a multi-terminal cooperative manner provided in the method embodiments and the summary of the present disclosure. The processor 402 may be an integrated circuit chip and has a signal processing capability. In an implementation process, steps in the foregoing methods can be implemented using a hardware integrated logical circuit in the processor 402, or using an instruction in a form of software. The processor 402 may be a general purpose processor, a digital signal processor (DSP), an ASIC, a field-programmable gate array (FPGA) or another programmable logic device, a discrete gate or a transistor logic device, or a discrete hardware component. The processor 402 may implement or perform the methods, the steps, and logical block diagrams that are disclosed in the embodiments of the present disclosure. The general purpose processor may be a microprocessor, or the processor may be any conventional processor or the like. The steps of the methods disclosed with reference to the embodiments of the present disclosure may be directly performed by a hardware decoding processor, or may be performed using a combination of hardware and software units in the decoding processor. A software unit may be located in a mature storage medium in the art, such as a random-access memory (RAM), a flash memory, a read-only memory (ROM), a programmable ROM (PROM), an electrically erasable PROM (EEPROM), or a register. The storage medium is located in the memory 404, and the processor 402 reads information in the memory 404 and completes the steps in the foregoing methods in combination with hardware of the processor 402.

The memory 404 may be a ROM, a static storage device, a dynamic storage device, or a RAM. The memory 404 may store an operating system and another application program. When functions that need to be performed by the units included in the terminal 300 provided in the embodiments of the present disclosure are implemented using software or firmware, or when the methods for playing an audio file in a multi-terminal cooperative manner provided in the method embodiments and the summary of the present disclosure are performed, program code used to implement the technical solutions provided in the embodiments of the present disclosure is stored in the memory 404, and the processor 402 performs the operations that need to be performed by the units included in the terminal 300, or performs the methods for playing an audio file in a multi-terminal cooperative manner provided in the method embodiments of the present disclosure.

The input/output interface 406 is configured to receive input data and information, and output data such as an operation result.

The communications interface 408 uses a transceiver apparatus, for example but not limited to, a transceiver, to implement communication between the terminal 400 and another device or a communications network.

The bus 410 may include a path, for transmitting information between the components (for example, the processor 402, the memory 404, the input/output interface 406, and the communications interface 408) of the terminal 400.

It should be noted that although the terminal 400 shown in FIG. 4 shows only the processor 402, the memory 404, the input/output interface 406, the communications interface 408, and the bus 410, in a specific implementation process, a person skilled in the art should understand that the terminal 400 further includes other components required for implementing normal running, for example, a display, a camera, and a gyroscope sensor. In addition, according to a specific requirement, a person skilled in the art should understand that the terminal 400 may further include a hardware component for implementing another additional function. In addition, a person skilled in the art should understand that the terminal 400 may include only a component essential for implementing the embodiments of the present disclosure, but not necessarily include all the components shown in FIG. 4.

It may be understood that, for operations performed by the elements of the terminal in this embodiment, refer to the related descriptions in the foregoing method embodiments and the summary. Details are not described herein again.

It should be noted that, for simplicity of description, the foregoing method embodiments are expressed as a combination of a series of actions. However, a person skilled in the art should appreciate that the present disclosure is not limited to the described action sequence. That is because according to the present disclosure, some steps may be performed in another sequence or performed simultaneously. In addition, a person skilled in the art should also appreciate that, actions and units in the specification are not necessary for the present disclosure.

A person of ordinary skill in the art may understand that all or some of the procedures of the methods in the foregoing embodiments may be implemented by a computer program instructing relevant hardware. The program may be stored in a computer-readable storage medium. When the program is run, the procedures of the methods in the embodiments are performed. The foregoing storage medium may be a magnetic disk, an optical disc, a ROM, a RAM, or the like.

The present disclosure is described with reference to the flowcharts and/or block diagrams of the method, the device (system), and the computer program product according to the embodiments of the present disclosure. It should be understood that computer program instructions may be used to implement each procedure and/or each block in the flowcharts and/or the block diagrams and a combination of a procedure and/or a block in the flowcharts and/or the block diagrams. These computer program instructions may be provided for a processor of a general-purpose computer, a special-purpose computer, an embedded processor, or another programmable data processing device to generate a machine such that the instructions executed by the processor of the computer or the other programmable data processing device generate an apparatus for implementing a specific function in one or more procedures in the flowcharts and/or in one or more blocks in the block diagrams.

These computer program instructions may alternatively be stored in a computer readable memory that can instruct a computer or another programmable data processing device to work in a specific manner such that the instructions stored in the computer readable memory generate an artifact that includes an instruction apparatus. The instruction apparatus implements a specific function in one or more procedures in the flowcharts and/or in one or more blocks in the block diagrams.

These computer program instructions may alternatively be loaded onto a computer or another programmable data processing device such that a series of operations and steps are performed on the computer or the other programmable device, thereby generating computer-implemented processing. Therefore, the instructions executed on the computer or the other programmable device provide steps for implementing a specific function in one or more procedures in the flowcharts and/or in one or more blocks in the block diagrams.

Although some optional embodiments of the present disclosure have been described, a person skilled in the art can make additional changes and modifications to these embodiments once they learn of the basic concept. Therefore, the following claims are intended to be construed as to cover the optional embodiments and all changes and modifications falling within the scope of the present disclosure.

A person skilled in the art can make various modifications and variations to the embodiments of the present disclosure without departing from the scope of the embodiments of the present disclosure. In this way, the present disclosure is intended to cover these modifications and variations provided that these modifications and variations of the embodiments of the present disclosure fall within the scope of the claims and equivalent technologies of the claims of the present disclosure.

What is claimed is:

1. A method for playing an audio file in a multi-terminal cooperative manner, implemented by a terminal, comprising:

obtaining the audio file comprising an audio signal frame, wherein the audio signal frame comprises a left channel signal and a right channel signal;

obtaining a central channel signal and a surround channel signal based on the left channel signal and the right channel signal;

obtaining a current location of a virtual sound source corresponding to the central channel signal;

generating, based on the current location and the central channel signal, a first sound channel signal corresponding to the terminal, wherein the first sound channel is one of a plurality of sound channel signals that simulate a current sound field of the virtual sound source;

superposing the sound channel signal on the surround channel signal to obtain a first to-be-played sound channel signal corresponding to the terminal; and playing the first to-be-played sound channel signal.

2. The method of claim 1, wherein the terminal is a source terminal, and wherein the method further comprises controlling a sink terminal to play a second to-be-played sound channel signal different from the to-be-played sound channel signal, wherein the second to-be-played sound channel signal is one of a plurality of to-be-played sound channel signals, and to cooperatively play the to-be-played sound channel signals with the terminal.

3. The method of claim 1, further comprising:

obtaining a movement speed of the virtual sound source and moment information of the audio signal frame; and determining, based on a preset movement track of the virtual sound source, the movement speed, and the moment information, the current location on the preset movement track.

4. The method of claim 3, wherein the audio signal frame comprises music data, and wherein the method further comprises:

determining rhythm information of the music data; and determining the movement speed based on the rhythm information.

5. The method of claim 4, further comprising determining the rhythm information based on the audio signal frame and N signal frames before the audio signal frame in the audio file, wherein N is an integer greater than zero.

6. The method of claim 3, wherein the movement track is a circle that rotates around a preset human ear location.

7. The method of claim 6, wherein the terminal is a source terminal, and wherein the source terminal is located in a plane in which the circle is located.

8. The method of claim 6, wherein the terminal is a source terminal, and wherein a sink terminal, controlled by the source terminal, is located in a plane in which the circle is located.

9. A terminal for playing an audio file in a multi-terminal cooperative manner, wherein the terminal comprises:

a memory configured to store instructions; and a processor coupled to the memory, wherein the instructions cause the processor to be configured to:

obtain the audio file comprising an audio signal frame, wherein the audio signal frame comprises a left channel signal and a right channel signal;

obtain a central channel signal and a surround channel signal based on the left channel signal and the right channel signal;

generate a current location of a virtual sound source corresponding to the central channel signal;

generate, based on the current location and the central channel signal, a first sound channel signal corresponding to the terminal, wherein the first sound channel signal is one of a plurality of sound channel signals that simulate a current sound field of the virtual sound source;

superpose the sound channel signal on the surround channel signal to obtain a first to-be-played sound channel signal corresponding to the terminal; and play the to-be-played sound channel signal.

10. The terminal of claim 9, wherein the terminal is a source terminal, and wherein the instructions further cause the processor to be configured to control a sink terminal to play a second to-be-played sound channel signal different from the first to-be-played sound channel signal, wherein the second to-be-played sound channel signal is one of a plurality of to-be-played sound channel signals, and to cooperatively play the to-be-played sound channel signals with the terminal.

11. The terminal of claim 9, wherein the instructions further cause the processor to be configured to:

obtain a movement speed of the virtual sound source and moment information of the audio signal frame; and determine, based on a preset movement track of the virtual sound source, the movement speed, and the moment information, the current location on the preset movement track.

12. The terminal of claim 11, wherein the audio signal frame comprises music data, and wherein the instructions further cause the processor to be configured to:

determine rhythm information of the music data; and determine the movement speed based on the rhythm information.

13. The terminal of claim 12, wherein the instructions further cause the processor to be configured to determine the rhythm information based on the audio signal frame and N signal frames before the audio signal frame in the audio file, and wherein N is an integer greater than zero.

14. The terminal of claim 11, wherein the movement track is a circle that rotates around a preset human ear location.

15. The terminal of claim 14, wherein the terminal is a source terminal, and wherein the source terminal is located in a plane in which the circle is located.

16. The terminal of claim 14, wherein the terminal is a source terminal, and wherein a sink terminal, controlled by the source terminal, is located in a plane in which the circle is located.

17. A computer program product comprising computer-executable instructions for storage on a non-transitory computer-readable medium that, when executed by a processor, cause a terminal to:

obtain an audio file comprising an audio signal frame, wherein the audio signal frame comprises a left channel signal and a right channel signal;

obtain a central channel signal and a surround channel signal based on the left channel signal and the right channel signal;

generate a current location of a virtual sound source corresponding to the central channel signal;

generate, based on the current location and the central channel signal, a first sound channel signal corresponding to the terminal, wherein the first sound channel is one of a plurality of sound channel signals that simulate a current sound field of the virtual sound source;

superpose the sound channel signal on the surround channel signal to obtain a first to-be-played sound channel signal corresponding to the terminal; and play the first to-be-played sound channel signal.

18. The computer program product of claim 17, wherein the terminal is a source terminal, and wherein the computer-executable instructions further cause the terminal to control a sink terminal to play a second to-be-played sound channel signal different from the first to-be-played sound channel signal, wherein the second to-be-played sound channel signal is one of a plurality of to-be-played sound channel signals, and to cooperatively play the to-be-played sound channel signals with the terminal.

19. The computer program product of claim 17, wherein the computer-executable instructions further cause the terminal to:

obtain a movement speed of the virtual sound source and moment information of the audio signal frame; and determine, based on a preset movement track of the virtual sound source, the movement speed, and the moment information, the current location on the preset movement track.

20. The computer program product of claim 19, wherein the audio signal frame comprises music data, and wherein the computer-executable instructions further cause the terminal to:

determine rhythm information of the music data; and determine the movement speed based on the rhythm information.

* * * * *